United States Patent [19]

D'Angelo et al.

[11] 4,151,770

[45] May 1, 1979

[54] APPARATUS FOR ALTERNATELY FEEDING AND CUTTING TWO DIFFERENT WIDTHS OF WEB MATERIAL

[75] Inventors: Joseph J. D'Angelo, Wycoff; Lawrence S. Maccherone, Ringwood, both of N.J.

[73] Assignee: Flexible Design Packaging Machine Company, Hawthorne, N.J.

[21] Appl. No.: 842,285

[22] Filed: Oct. 14, 1977

[51] Int. Cl.[2] ..... B26D 5/24

[52] U.S. Cl. ..... 83/262; 83/208; 83/221; 83/650; 226/110

[58] Field of Search ..... 83/272, 282, 171, 208, 83/221, 261, 262, 650; 226/110, 115, 162

[56] References Cited

U.S. PATENT DOCUMENTS

| | | | |
|---|---|---|---|
| 3,300,113 | 1/1967 | Lane | 226/110 |
| 3,924,497 | 12/1975 | D'Angelo | 83/171 |

*Primary Examiner*—J. M. Meister

*Attorney, Agent, or Firm*—Parmelee, Johnson, Bollinger & Bramblett

[57] ABSTRACT

Two webs of different widths of microfoam are fed from web rolls by a continuously driven roller and a pinch roller through a heated-wire cutting station. At the cutting station, a single cutting wire extends across the path of both webs; a single set of clamping plates is also provided. The feed of the webs may be alternately interrupted by a clamping device which includes a pivotal clamp support that can be swung in a rocking motion back and forth about its pivot axis. A pair of U-shaped channels located on either side of the support pivot axis extend across the width of both webs and can be swung respectively toward and away from the webs. Removable clamping segments are fitted into a portion of each U-shaped channel to define adjustable length clamping elements which extend across the widths of respective webs for accommodating various sizes of webs. By swinging the clamp support between two positions, the clamping device alternately clamps one or the other web against a fixed clamp bar. To drive either web, the pinch roller is moved toward the driven roller and stopped when the rollers are at a predetermined minimum spacing less than the thickness of the webs. The frictional force of the driven roller on the web is sufficient to pull the unclamped web but not to tear the clamped web.

12 Claims, 11 Drawing Figures

22
18
25
28
122
120
119
117
132
116
128
124
130
126
114
41
40
30
44
42
29
32
49
48
46
86
50
52
74
68
84
58
72
75
86
59
66
73
64
61
70
63
34
18

APPARATUS FOR ALTERNATELY FEEDING AND CUTTING TWO DIFFERENT WIDTHS OF WEB MATERIAL

DESCRIPTION

The invention relates to a method and apparatus for alternately feeding and cutting two different widths of web material and more particularly to a web feeding machine and method for dispensing sheets of microfoam of different widths.

In a prior U.S. Pat. No. 3,924,497, a microfoam sheet dispensing apparatus is disclosed in which a single web of microfoam is driven by nip rollers into a hot-wire cutting station where the web is clamped and cut. The device of that patent is for dispensing a single sheet of microfoam. In a specific application, the microfoam sheets taken from the dispensing apparatus are used to cover furniture prior to shipping. In packaging the production runs from the various manufacturing departments in a factory, the width requirements for covering the various sizes and types of furniture vary, as do the length requirements. The dispensing apparatus of the aforementioned patent permits dispensing of variable lengths, but in order to dispense sheets of different widths, at least two machines are required. The added expense and space requirements are undesirable, and the use of two machines is difficult for the shipping personnel who must continually travel to them. The cost of two such machines can be prohibitive, and thus the user of the foam must often make do with a single machine, dispensing sheets wide enough for all needs and employing additional handling steps for further cutting the microfoam to meet any lesser width requirements. This is not only wasteful of the microfoam, but also partially defeats the advantage of a dispenser, that advantage being that the hand measuring and cutting of the microfoam is unnecessary.

It is thus an object of this invention to provide a sheet dispensing method and apparatus which permit the dispensing of different widths of web material from a single machine.

A further object of this invention is to provide a sheet dispenser for dispensing sheets of different widths from either of two rolls of web material.

Yet another object of this invention is to provide an apparatus for dispensing sheets from a plurality of web rolls with only slight modification of a single-roll sheet dispenser.

In accordance with the present invention in one of its aspects, at least two webs are pulled from web sources to a single operating station. A continuous pulling force is applied to both webs during the dispensing of either one, and clamp means including clamping elements associated with respective webs is positioned along the paths of the webs between the web sources and the means for pulling the webs. The clamping elements associated with respective webs are mounted on a support which is movable between either of two positions. In a first position, a first clamping element clamps the first web and in a second position a second clamping element clamps the second web, the unclamped web being dispensed for use.

According to other aspects of the invention, the clamp support is pivotal and the clamping elements are positioned on either side of the pivot axis line of the support. As the support swings to a first position, a first clamping element clamps the first web, and as the clamp support swings to a second position the second clamping element clamps the second web.

According to yet other aspects of the invention each clamping element comprises a plurality of removable clamping segments fitted into a U-shaped channel. The number of segments in a clamping element may be varied quickly and conveniently so that each element is approximately as long as its respective web is wide for meeting changes in usage requirements by accommodating different sizes of web material.

In accordance with still further aspects of the invention, a sheet dispensing apparatus includes a single cutting mechanism to alternately cut sheets from either of two webs of material. Both webs are pulled toward the cutting station by a drive roller and pinch roller. Feed of either of the webs is interrupted by a clamping means which pivots into a first position to interrupt feed of a first web and which pivots into a second position to interrupt feed of a second web.

An advantage of this invention is that by providing a single dispenser wide enough to carry two webs of different widths and by making a simple modification of the single web dispenser, sheets of different widths and lengths may be dispensed to more closely meet the specific needs of the operator using the sheets. Further, the modification may be easily adjusted so that the widths of sheets dispensed may be changed quickly and conveniently without production "down time".

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF PREFERRED EMBODIMENTS OF THE INVENTION

Figure 1:
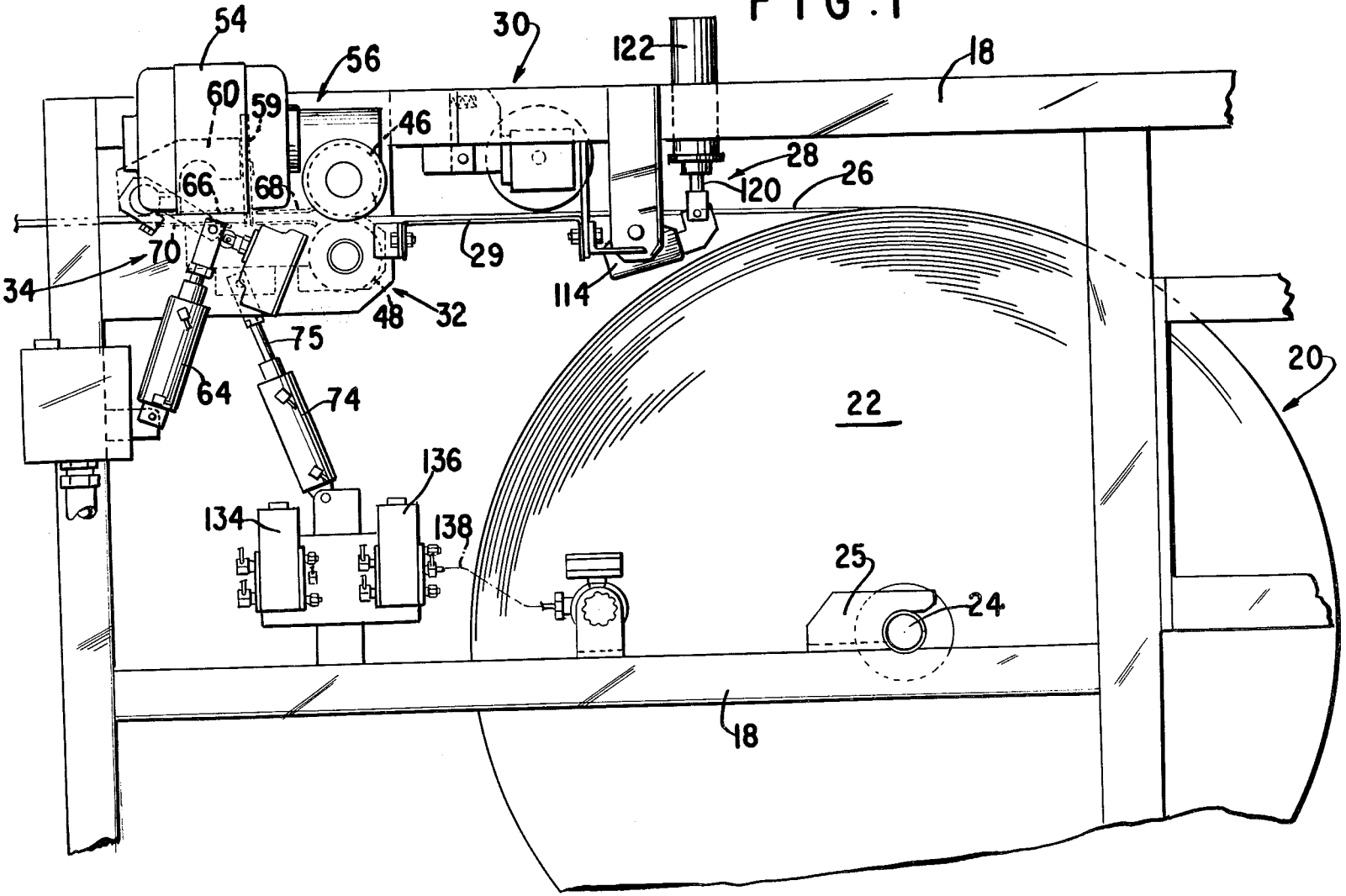
FIG. 1 is a side elevational view of a preferred embodiment of the multiple web sheet dispensing apparatus of the present invention and for practising the method of this invention.

Referring to FIG. 1, the sheet dispensing apparatus comprises a frame 18 with a first web source or roll 20 of microfoam 22 mounted for free rotation about a shaft 24. This shaft is removably seated in a support bracket 25 for changing the rolls of web material. A second roll of web material of a width different from that in roll 2 is mounted behind roll 22 on the same shaft 24. The web path of the webs taken from each of the web rolls is through a clamping station 28 and over a web platform 29 positioned beneath a length measuring station 30. From the platform 29, the web is pulled through the roller drive section 32 into a cutting station 34.

Figure 2:
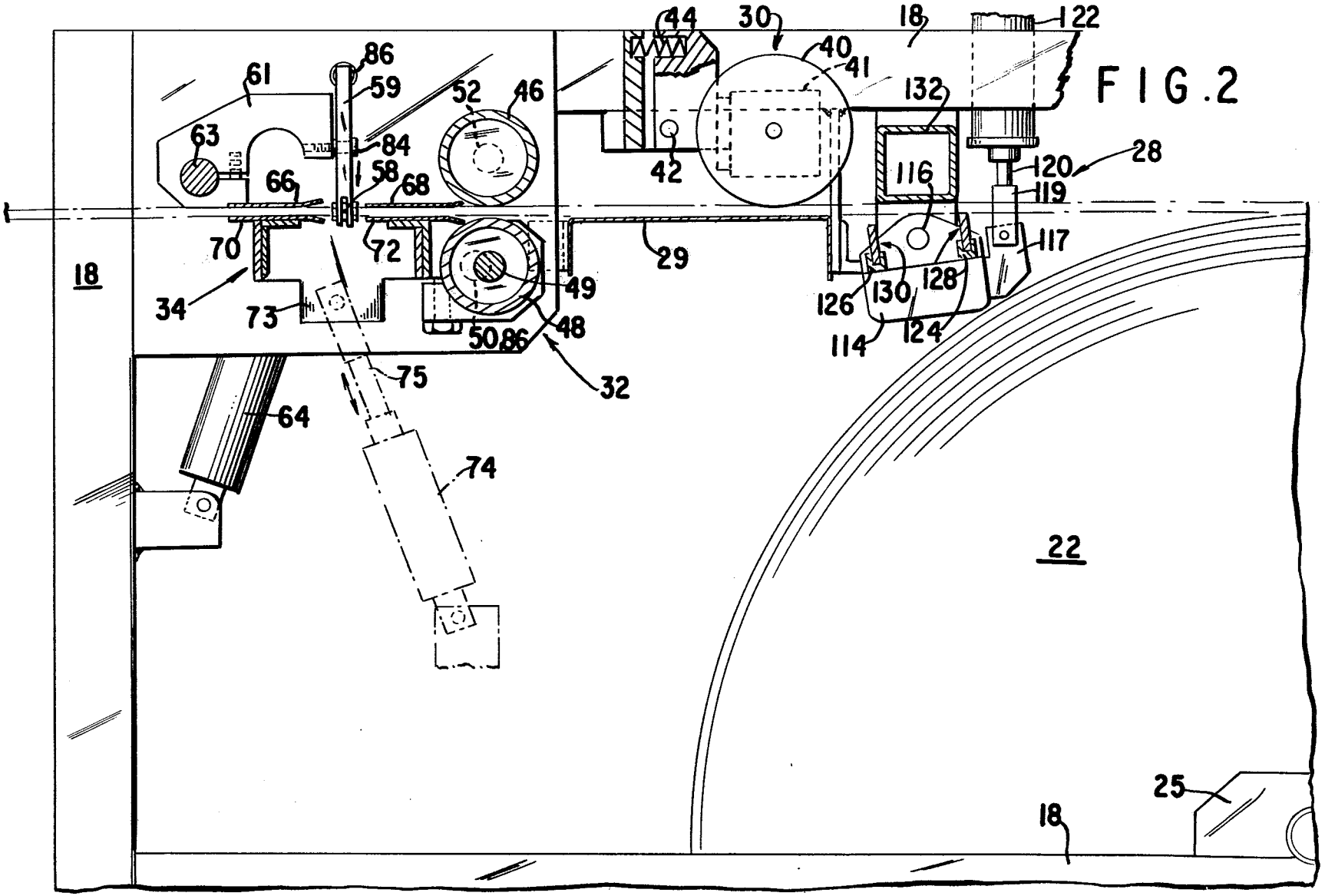
FIG. 2 is a partial elevational sectional view of the apparatus of FIG. 1 on enlarged scale and showing the clamping station, measuring station, web drive and cutting station.
Figure 8:
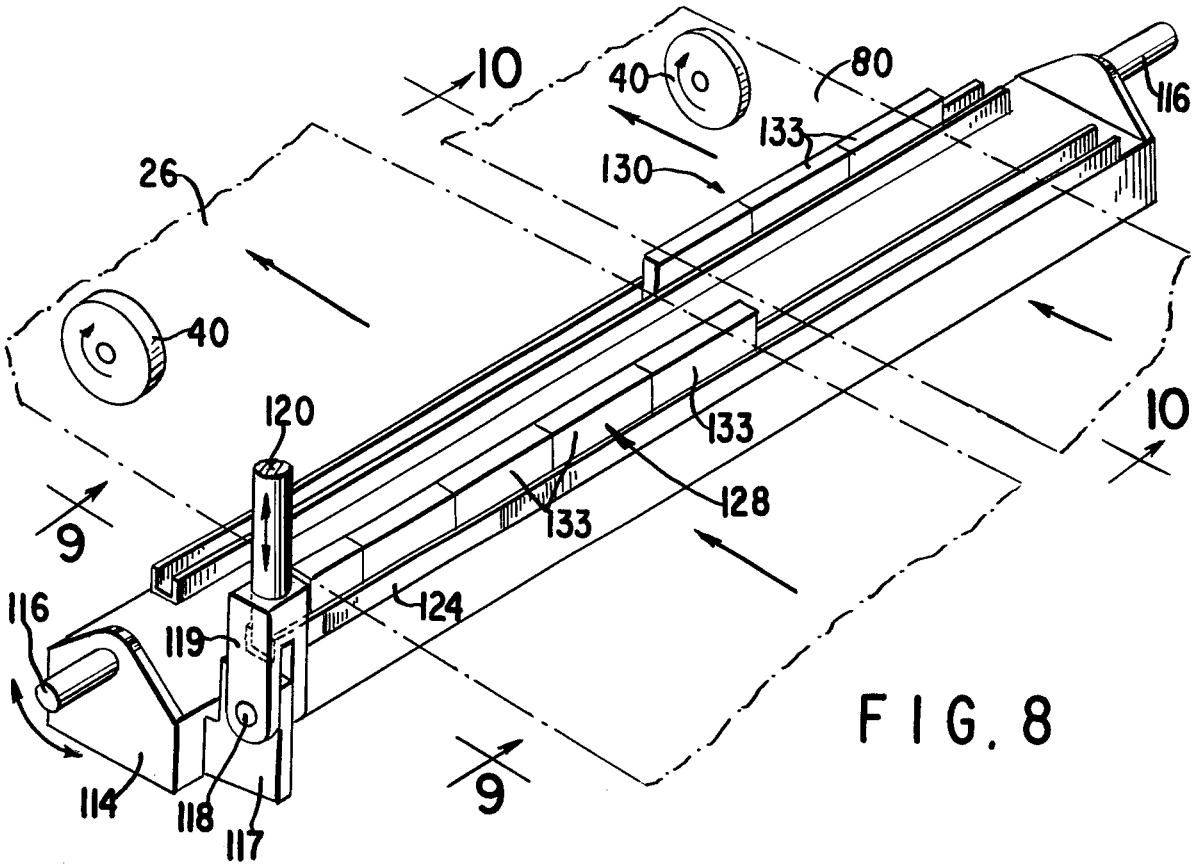
FIG. 8 is an isometric view of the clamping means of the present invention.

Referring now to FIG. 2, the length measuring station 30 comprises a measuring wheel 40 mounted on a bracket 41 pivotally mounted on a pin 42 and biased against the web 26 by a compressed spring 44. The measuring device 30 includes a suitable transducer and counting circuitry for measuring rotation of the wheel 40 and thus give an indication of the length of microfoam passed between the wheel 40 and platform 29. The automatic controls of the dispensing apparatus can then be set to cut predetermined lengths of microfoam sheets. A sheet is automatically cut from the web when the measuring mechanism 30 indicates that the predetermined length has passed to the cutting station. Separate measuring devices are mounted over each of the webs, as indicated in FIG. 8.

The web drive includes a drive roller 46 and a nip or pinch roller 48. The pinch roller 48 is mounted for free rotation on its axial shaft 49 and, as will be described in more detail subsequently, the shaft 49 is mounted on an eccentric shaft 50 so that the pinch roller 48 may be moved out of contact with web 26 during a cutting operation as shown in FIG. 2.

Figure 3:
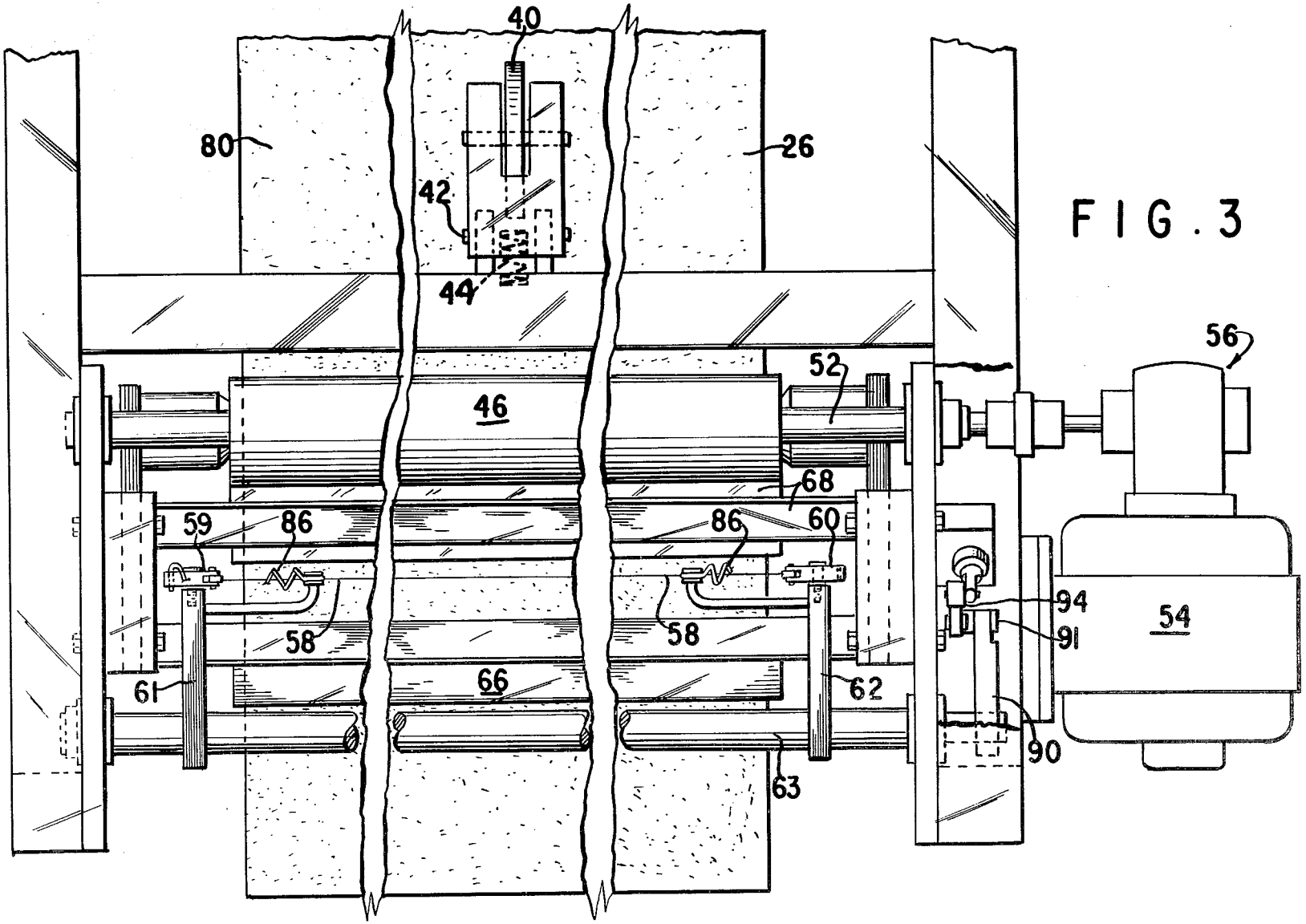
FIG. 3 is a partial plan view of the apparatus of FIG. 1 showing the web feeding, measuring and cutting apparatus.

Drive roller 46 is mounted on a drive shaft 52 which is driven by a motor 54 shown in FIG. 3. The drive from the motor 54 is through a worm gear speed-reducing coupling 56.

Figure 4:
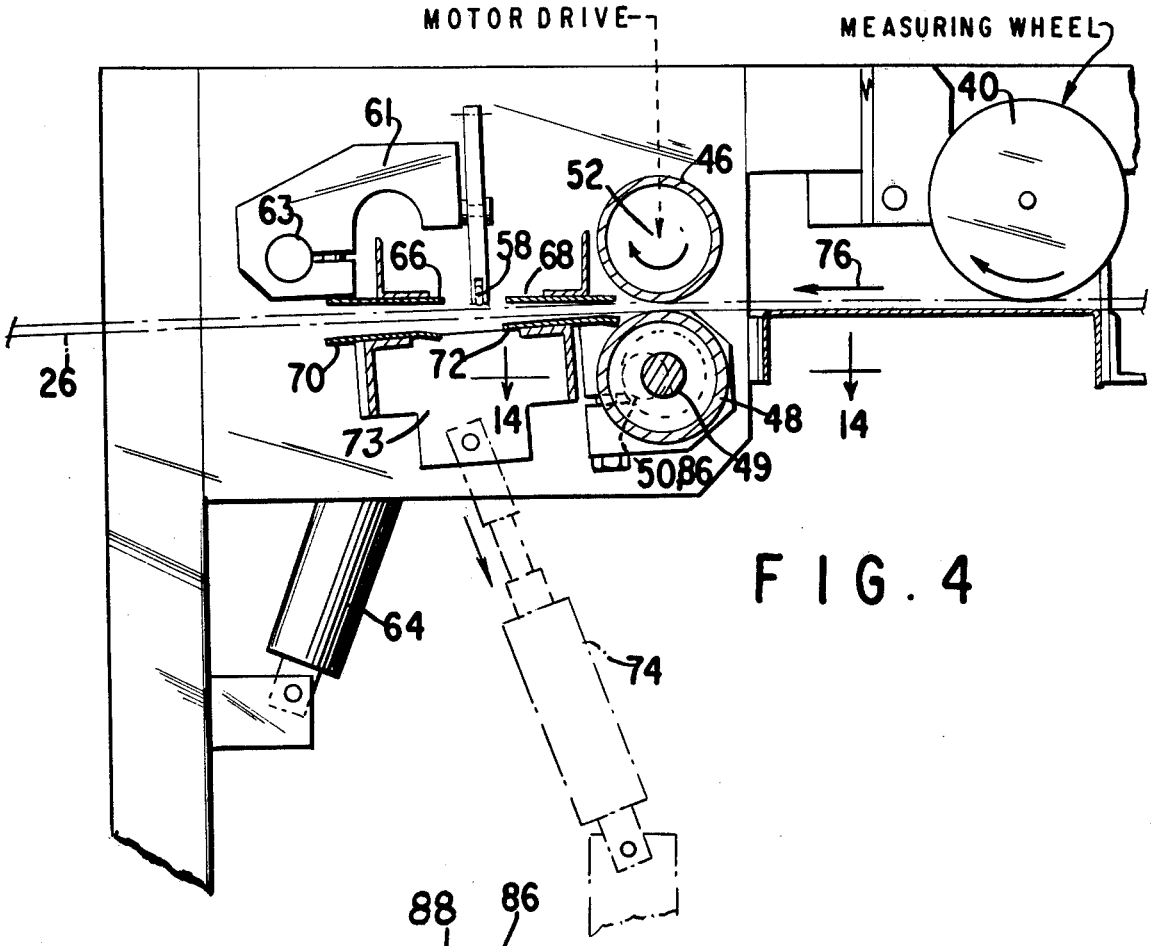
FIG. 4 is a sectional view of the web driving and cutting mechanism as shown in FIG. 2 but with the cutting station clamp and the pinch roller in the web feeding position.
Figure 5:
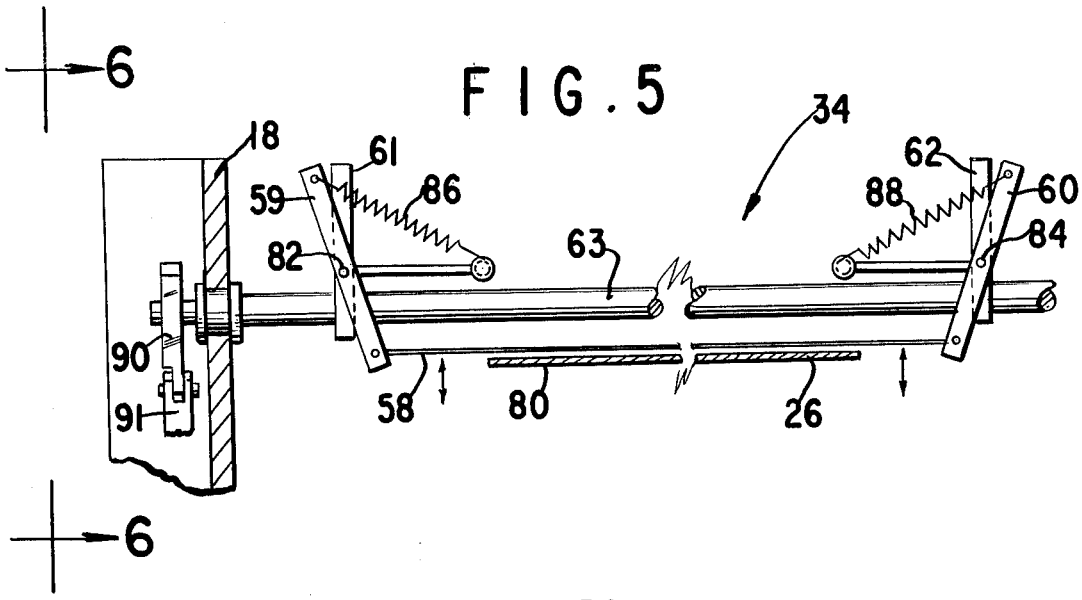
FIG. 5 is a front view of the web cutting mechanism as seen in FIGS. 2, 3 and 4.

As seen most clearly in FIG. 5, the cutting station 34 includes an electrically heated cutting wire 58 stretched across the web path. The cutting wire is a suitable low voltage, high current heating element. This heated wire is stretched between wire supports 59 and 60 on pivotal mounts 61 and 62 (see also FIG. 4). The mounts are fixed to a shaft 63 which can be turned to move the hot wire 58. Movement of the heated wire is controlled by a pneumatic drive cylinder 64 as will be described in more detail with respect to FIG. 6.

Clamping plates 66 and 68 (FIG. 2) are positioned over the web path on either side of the cutting wire 58. These plates are fixed with respect to the dispenser frame 18. Below the web path, movable clamping plates 70 and 72 cooperate with plates 66 and 68 to clamp the web therebetween during the cutting operation. These lower plates 70 and 72 are mounted on a pivoted member 73, pivotal about the shaft 50. This member 73 is moved into and out of the web clamping position by means of a pneumatic cylinder 74 having its piston rod connected to the member 73.

Figure 4A:
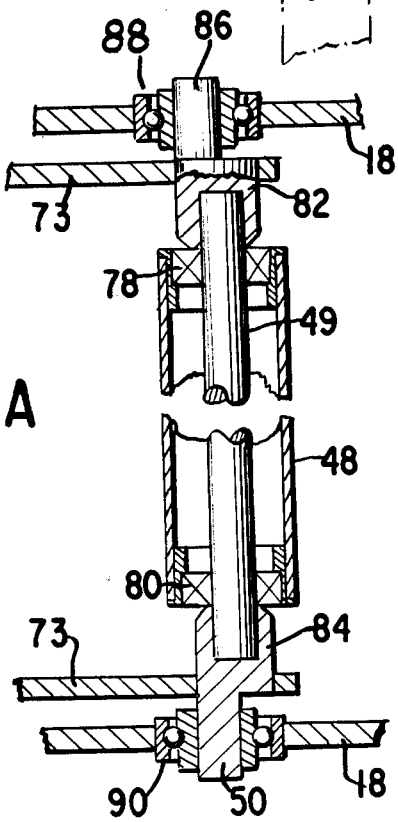
FIG. 4A is a sectional view of the eccentrically mounted pinch roller of FIG. 4 taken along line A—A.

FIG. 4 shows the heated wire 58 pulled upwardly away from the web 26 and the lower clamping plates 70 and 72 on the movable frame 73 pulled downwardly away from the web path. When the plates 70 and 72 are pulled down away from the web path, the eccentrically mounted pinch roller 48 moves into engagement with the web, pressing it against the driven roller 46 to thereby drive the web in the direction indicated by the arrow 76. The mounting arrangement for pivoting the movable clamping plate frame 73 and the pinch roller 48 is best shown in FIG. 4A. The roller 48 is mounted for free rotation about the shaft 49 on bearings 78 and 80. Both the shaft 49 and the clamping plate frame 73 are fixed to hubs 82 and 84 which have eccentrically positioned shaft extensions 50 and 86. The entire lower clamping plate structure and pinch roller structure are mounted by means of bearings 88 and 90 to the main dispenser frame 18. Thus, as the pneumatic drive 74 (FIG. 4) moves the clamping plate frame 73 toward the web path, the frame pivots about shaft extensions 86 and 50. At the same time, roller 48, mounted slightly to the opposite side of eccentric shaft extensions 50 and 86 moves slightly away from the web 26, thereby stopping feed of the web as the cutter station clamping plates are moved into position.

Figure 6:
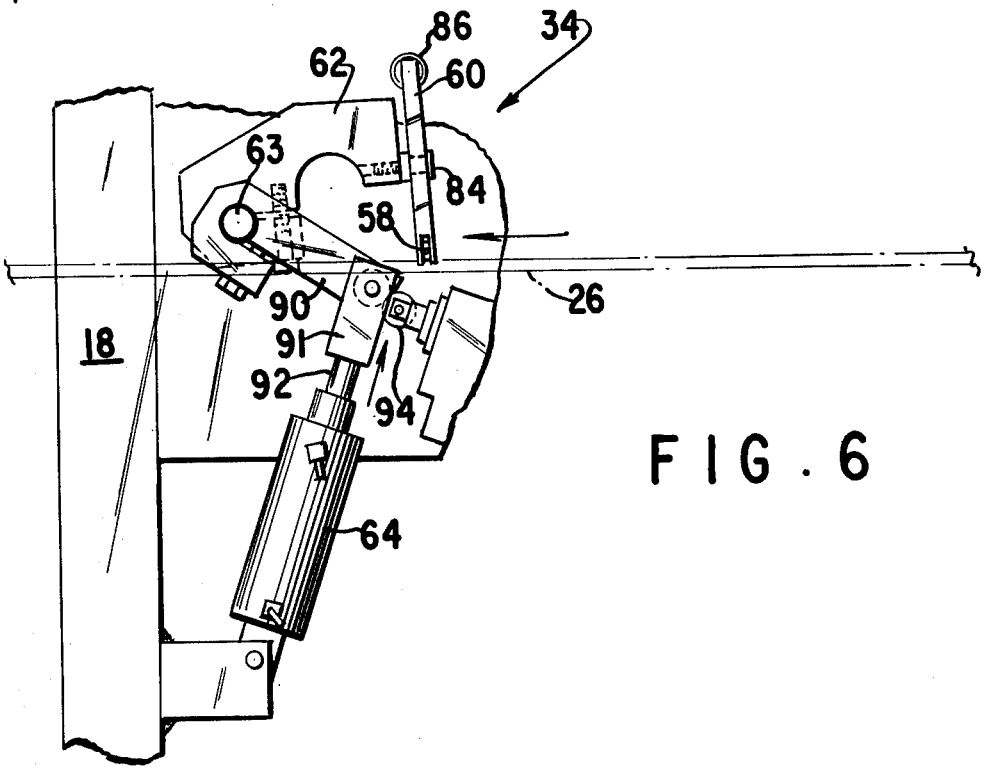
FIG. 6 is a side view of the drive for the web cutting mechanism of FIG. 5 as seen from the positions 6—6 in FIG. 5.

The heated wire cutting mechanism is best shown in FIGS. 5 and 6. The wire supports 59 and 60 pivot about respective pins 82 and 84 and are biased by respective tension springs 86 and 88. As the upper ends of the wire supports 59 and 60 are pulled inward, the lower ends of these supports pull the heated wire 58 taut. This spring tension on the heated wire maintains the wire reasonably taut; but because the tension mechanism is yieldable, there is little risk of the wire 58 breaking during the cutting operation.

Referring to FIG. 6, it has already been noted that the spring supports 59 and 60 are mounted on mounts 61 and 62 which are fixed to a shaft 63. Also fixed to the shaft 63 is an operating arm 90 coupled at its end to a clevis 91 on the end of the piston rod 92 from the drive cylinder 64. A limit switch 94 is positioned adjacent to the end of the arm 90, and the switch contacts become closed when the arm 90 has been fully moved downward during the cutting action. This switch 94 is included in an interlock control circuit for the pneumatic drive cylinder 74 to preclude release of the web by clamping plates 70 and 72 and particularly to preclude movement of the pinch roller 48 against the web 26 during a cutting operation. The switch 94 is thus a safety feature which precludes further movement of the web 26 while the heated wire 58 is in any other than its uppermost position.

Figure 7:
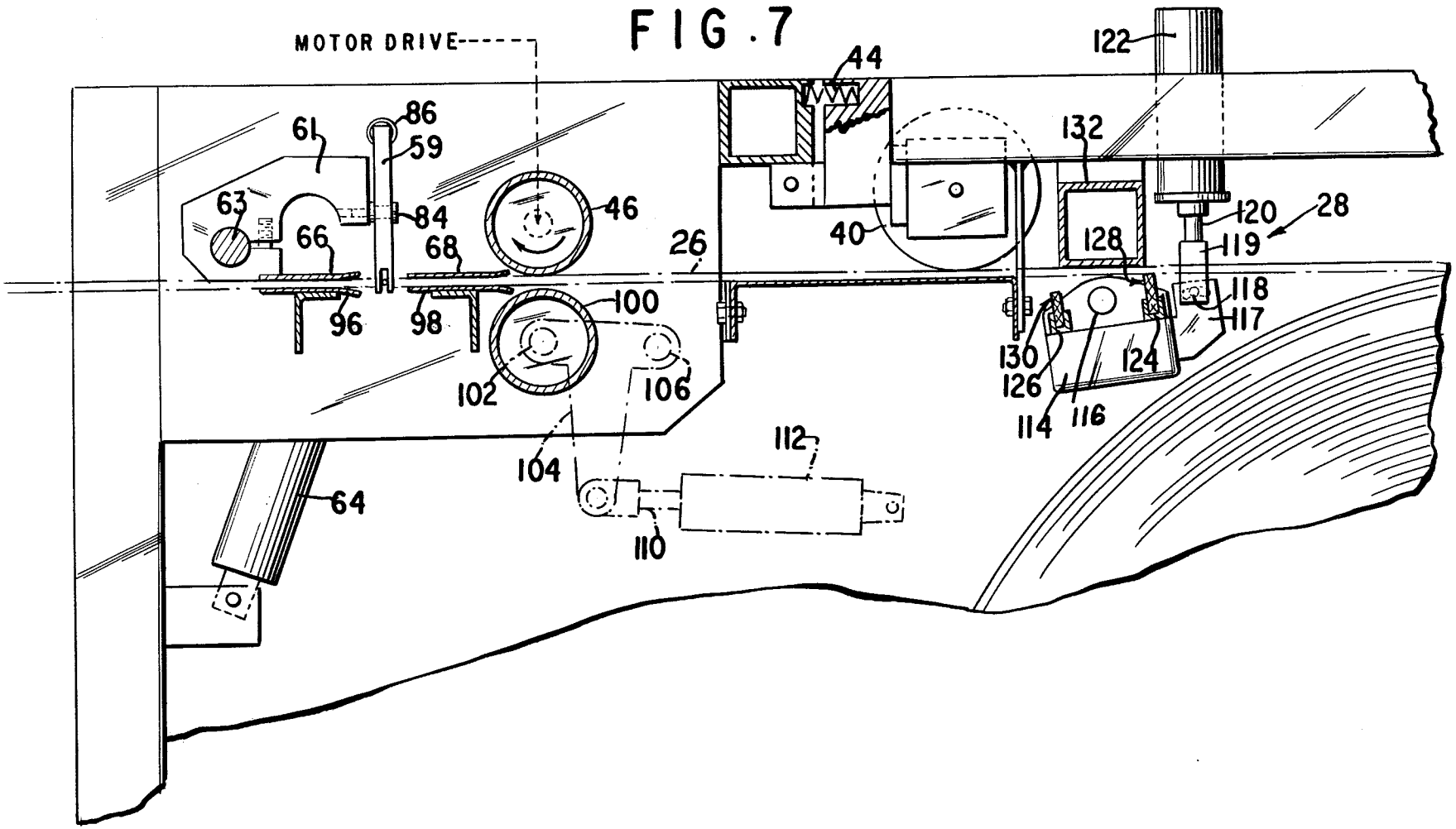
FIG. 7 is an alternative embodiment of the sheet dispensing apparatus of the invention in which the cutting station clamping mechanism is omitted.

FIG. 7 shows an alternative embodiment of the web drive and cutting station. In this embodiment, the pivoted clamping plates 70 and 72 are omitted, and a pair of stationary plates 96 and 98 are in a fixed position below the web path. Plates 96 and 98 are spaced from plates 66 and 68 in order to define a web path. The spacing between the plates is slightly greater than the microfoam thickness so as not to interrupt feed but to hold the microfoam flat at the cutting station. The pinch roller 100 is mounted for free rotation about a shaft 102 which extends between two pivotal members including T member 104. T member 104 pivots about a pin 106 as operated by movement of its lower arm 108 driven by the piston rod 128 from a pneumatic cylinder 112. Hence, as the rod 110 is moved to the left in the drawing, T member 104 pivots about the pin 106 moving the pinch roller 100 inward the drive roller 46, thereby driving the web 26.

Thus far, a dispensing apparatus including a single cutting element and a single drive means has been described for use with two webs in side-by-side coplanar relationship. The system thus far described is the same for a single web dispenser or a multiple web dispenser. It is by means of the clamping means now to be described that alternate dispensing of sheets of microfoam of different widths is possible.

As shown in FIGS. 2, 7 and 8, the clamping means at clamping station 28 comprises a movable clamp support 114 pivotal at each end about a pin 116 as seen in FIG. 8. The pivot axis defined by these pivot pins 116 runs across and parallel to the plane of the two webs. The clamp support 114 has an operating arm 117 which is connected by means of a pin 118 to a clevis 119 on a piston rod 120 of a pneumatic drive cylinder 122.

Spaced to either side of a plane normal to the web 26 and passing through the axis of pivots 116 are two U-shaped channel members 124 and 126. These channel members extend along opposite edges of the movable clamp support 114 and serve as first and second linear support elements for supporting first and second clamping elements 128 and 130. As can be seen in FIG. 8, the first clamping element 128 extends the width of the first web 26 and the second clamping element 130 extends the width of the second web 80.

Figure 10:
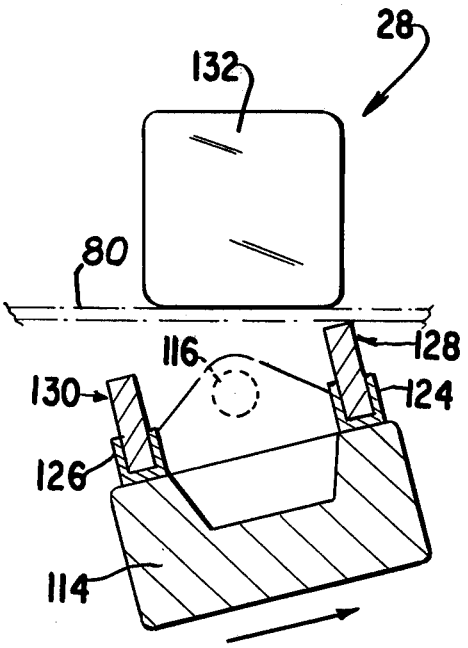
FIG. 10 is a sectional view similar to FIG. 9 showing the clamping means of FIG. 8 in a second position.

When the drive cylinder 112 (FIGS. 2 and 7) moves the support means 114 to the position shown in FIGS. 2, 7 and 10, the first clamping element 128 moves toward a third elongated clamping element 132 in the form of a fixed clamp bar extending across and closely adjacent to the web path. Thus, the first web 26 is clamped between clamp elements 128 and 132 and thus its feed is restrained. This first web 26 is stopped whether or not the pinch roller 48 (FIG. 2) or 100 (FIG. 7) is moved to place this web in frictional driving relationship with the constantly rotating drive roller 46. If this web is placed in driving relationship with the drive roller 46, the surface of this drive roller simply slides over the web 26 of microfoam. However, the other web 80 is still free to move and is fed by the drive roller 46 through the cutting station already described. The cutting wire extends across both web paths, but it only cuts whichever of the webs is positioned below the wire at that moment. With the first web 26 being restrained, only the web 80 is cut, and vice versa as will be explained.

Figure 9:
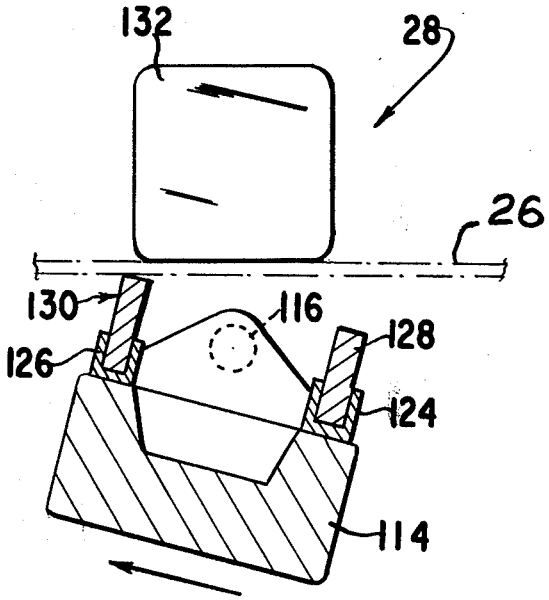
FIG. 9 is a sectional view of the clamping means of FIG. 8 in a first position, as taken along line 9—9 in FIG. 8.

When the piston rod 120 (FIGS. 2 or 7) pivots the support 114 into its second position as shown in FIG. 9, the second clamping element 130 clamps the second web 80 against the third clamping element 132. In this position, web 26 is free to be driven through the dispensing operation while feed of web 80 is interrupted.

As shown in FIG. 8, each of the clamping elements 128 and 130 comprises a number of removable clamping segments 133. These clamping segments 133 are shown as being short lengths of steel bar stock of rectangular cross section which fit snugly into the U-shaped channels 124 and 126. The lengths of the respective clamping elements 128 and 130 can be easily adjusted for webs of different widths by quickly and conveniently changing the number or relative lengths of the clamping segments 133 in each channel 124 or 126. If desired, the clamping segments 133 may be made of some yieldable material such as rubber in order that, once wedged into the U-shaped channels, nothing further is required to hold them in place. When these removable segments 133 are made of steel bar stock, they may be fitted snugly into the channels 124 and 126 with a slight interference fit so that the resilience of the channel walls plus their own weight hold them in place.

Thus, a sheet dispensing apparatus having great flexibility as to the widths of sheets dispensed from rolls of web material is provided. By virtue of this invention only a modest amount of additional equipment is required to provide a multiple sheet dispenser as compared to what is required in the prior art for a single sheet dispenser.

A wider machine frame 18 is required, as are a suitable mounting shaft 24 and support 25 for carrying two of the large rolls 20 in end-to-end mounted arrangement with different widths of web in the two rolls. The clamping station mechanism 28 is employed plus an additional measuring device 30 with associated electrical controls. The apparatus includes electrical control circuits, as will be understood by those specialists in the art, which actuate the various solenoid-controlled valves, such as indicated at 134 and 136 (FIG. 1) for controlling the feed of pressurized air from supply lines such as shown at 138 to the various pneumatic cylinders described. There is a manual selector switch which serves to control the actuation of the cylinder 122 (FIGS. 2 and 7) for determining which of the webs 26 or 80 is to be clamped. The arrangement of such a switch and its circuit will be understood by those specialists in the art and therefore is not shown.

In operation, a web of microfoam is led from each roll in a downstream direction along the feed path to the cut-off station. The driven feed roller 46 is located upstream from the cut-off station 34 and has a smooth surface extending transversely across the feed path of both webs. When either web is to be pulled by the feed rollers to advance that web to the cut-off station, the second feed roller, pinch roller 48, is moved toward the driven feed roller 46 by a pneumatic cylinder as already described. In either of the disclosed embodiments, some form of stop means is provided to stop the approach of the pinch roller 48 or 100 toward roller 46. The pinch roller is stopped when the rollers are at a predetermined minimum spacing which is less than the thickness of the webs and the pinch roller is held against the stop means by the pneumatic drive.

The microfoam web is a resilient, flexible cellular material which is somewhat compressible; thus, with the pneumatic cylinder drive forcing the pinch roller against the stop means, the microfoam is compressed between the two rolls. With the microfoam compressed, it exerts an expanding force on the surfaces of the two rollers and thus provides a sufficient frictional engagement with the smooth moving surface of the driven roller to exert a pulling force simultaneously to both webs. The predetermined minimum spacing between the rolls is set sufficiently close that the pulling force exerted on the two webs is sufficient to advance the unclamped web past the cut-off station; however, the spacing is sufficiently great that the pulling force exerted on the two webs is less than that which would tear the web when it is restrained by the clamping means. Hence, the smooth drive roll 46 drives the unclamped web through the cutting station, but merely slides over the clamped web. Once the desired length of the advancing web has been measured, both webs are stopped by pulling the pinch roller away from the drive roller. The web is then cut at that length to provide a sheet of microfoam of the proper width and length.

While the invention has been particularly shown and described with reference to preferred embodiments thereof, it will be understood by those skilled in the art that various changes in form and details may be made therein without departing from the spirit and scope of the invention as defined by the appended claims.

We claim:

1. A web feeding apparatus for feeding at least two webs of material from separate web sources to a single operating station, said apparatus comprising:

drive means displaced from said web sources for pulling each of said webs from their respective sources, and clamping means positioned along the paths of said webs between said drive means and said web sources, said clamping means including a first clamping element adjacent the path of a first web and a second clamping element adjacent the path of a second web, said clamping means being positionable in a first position and a second position, said first clamping element clamping said first web when said clamping means is in said first position and said second clamping element clamping said second web when said clamping means is in said second position, whereby feed of said first web is interrupted independent of said drive means when said clamp means is in said first position and the feed of said second web is interrupted independent of said drive means when said clamp means is in said second position.

2. The web feeding apparatus claimed in claim 1 wherein said drive means is a continuously driven drive roller associated with a pinch roller.

3. The web feeding apparatus claimed in claim 1 wherein said webs adjacent said clamp means are in a side-by-side coplanar relationship and wherein said clamping means comprises:

A third clamping element adjacent one side of said webs, a pivotal support means adjacent the other side of said webs, said support means being pivotal about a pivot axis extending across and generally parallel to said webs, said support means supporting said first clamping element adjacent to said first web but displaced from said pivot axis, said support means supporting said second clamping element adjacent to said second web but displaced from said pivot axis, said first and second clamping elements being on opposite sides of a plane normal to said web intersecting said pivot axis, and means for causing said support means to pivot about said pivot axis between the first and second positions, the first clamping element clamping the first web against the third clamping element when said support means is in said first position and the second clamping element clamping the second web against the third clamping element when said support means is in said second position.

4. The web feeding apparatus claimed in claim 3 wherein:

said support means comprises a first generally linear support element supporting said first clamping element and a second generally linear support element supporting said second clamping element, each of said support elements extending across both webs parallel to said pivot axis, said clamping elements each comprising a plurality of removable clamping segments mounted end-to-end on respective support elements, the length of each clamping element across a respective web being determined by the lengths of and the number of clamping segments in that clamping element, whereby the lengths of said clamping element are variable dependent on the widths of said webs.

5. The web feeding apparatus claimed in claim 4 wherein said drive means is a continuously driven drive roller associated with a pinch roller.

6. The web feeding apparatus claimed in claim 4 wherein said support elements are U-shaped channel members and each of said clamping segments is a short length of bar stock of rectangular cross section fitted into one of said U-shaped channel members.

7. A sheet dispensing apparatus for dispensing sheets of predetermined lengths from at least two webs, said sheet dispensing apparatus comprising:

at least two separate web sources;

drive means displaced from said web sources for pulling each of said webs from their respective sources;

cutting means extending across the first and second webs, said cutting means moving across both web paths in a single movement, thereby cutting whichever web is positioned at said cutting means; and clamping means positioned along the paths of said webs between said drive means and said web sources, said clamping means including a first clamping element adjacent the path of said first web and a second clamping element adjacent the path of said second web, said clamping means being positionable in a first position and a second position, said first clamping element clamping said first web when said clamping means is in said first position and said second clamping element clamping said second web when said clamping means is in said second position, whereby feed of said first web is interrupted independent of said drive means when said clamp means is in said first position and the feed of said second web is interrupted independent of said drive means when said clamp means is in said second position.

8. The sheet dispensing apparatus claimed in claim 7 wherein said drive means is a continuously driven drive roller associated with a pinch roller.

9. The sheet dispensing apparatus claimed in claim 7 wherein said webs adjacent said clamping means are in side-by-side coplanar relationship and wherein said clamping means comprises:

a third clamping element adjacent one side of said webs, a pivotal support means adjacent the other side of said webs, said support means being pivotal about a pivot axis extending across and generally parallel to said webs, said support means supporting said first clamping element adjacent to said first web but displaced from said pivot axis, and supporting said second clamping element adjacent to said second web but displaced from said pivot axis, said first and second clamping elements being on opposite sides of a plane normal to said web and intersecting said pivot axis, and means for causing said support means to pivot about said pivot axis between said first and second positions, the first clamping element clamping the first web against the third clamping element when said support means is in said first position and the second clamping element clamping the second web against the third clamping element when said support means is in said second position.

10. The sheet dispensing apparatus claimed in claim 9 wherein:

said support means comprises a first generally linear support element supporting said first clamping element and a second generally linear support element supporting said second clamping element, each of said support elements extending across both webs parallel to said pivot axis, said clamping elements each comprising a plurality of removable clamping segments mounted end-to-end on respective support elements, the length of each clamping element across a respective web being determined by the lengths of and the number of clamping segments in that clamping element, whereby the lengths of said clamping elements are variable dependent on the widths of said webs.

11. The sheet dispensing apparatus claimed in claim 10 wherein said drive means is a continuously driven drive roller associated with a pinch roller.

12. The sheet dispensing apparatus claimed in claim 9 wherein said support elements comprise U-shaped channel members and said clamping segments are short lengths of bar stock of rectangular cross section fitted into respective U-shaped channel members.

* * * * *